US006030074A

United States Patent [19]

Barinaga

[11] Patent Number: 6,030,074

[45] Date of Patent: Feb. 29, 2000

[54] METHOD AND APPARATUS FOR DELIVERING PRESSURIZED INK TO A PRINTHEAD

[75] Inventor: John Barinaga, Vancouver, Wash.

[73] Assignee: Hewlett-Packard Company, Palo Alto, Calif.

[21] Appl. No.: 08/988,018

[22] Filed: Dec. 10, 1997

Related U.S. Application Data

[63] Continuation of application No. 08/679,579, Jul. 15, 1996, abandoned.

[51] Int. Cl.[7] ..... B41J 2/175

[52] U.S. Cl. ..... 347/85

[58] Field of Search ..... 347/30, 84, 85, 347/86

[56] References Cited

U.S. PATENT DOCUMENTS

| | | | |
|---|---|---|---|
| 4,432,005 | 2/1984 | Duffield et al. | 347/86 |
| 4,558,326 | 12/1985 | Kimura et al. | 347/30 |
| 4,568,954 | 2/1986 | Rosback | 347/86 |
| 5,650,811 | 7/1997 | Seccombe et al. | 347/85 |
| 5,719,609 | 2/1998 | Hauck et al. | 347/85 |

*Primary Examiner*—N. Le
*Assistant Examiner*—Anh T. N. Vo

[57] ABSTRACT

An apparatus for delivering pressurized ink to a printhead, according to the invention, includes a deformable bag for holding ink, a pressurizable container substantially surrounding the bag for exerting fluid pressure on said bag and pressurizing any ink within the bag, and a sealable ink outlet port for fluid communication with the ink bag. The port is fluidically connectable to the printhead so that pressurized ink is deliverable to the printhead.

11 Claims, 3 Drawing Sheets

METHOD AND APPARATUS FOR DELIVERING PRESSURIZED INK TO A PRINTHEAD

This application is a continuation of application Ser. No. 08/679,579, filed Jul. 15, 1996, now abandoned.

FIELD OF INVENTION

The present invention generally relates to print cartridges used in computer controlled printers, and more particularly, to methods and apparatus for delivering ink to such print cartridges.

BACKGROUND OF INVENTION

The art of ink-jet technology is relatively well developed. Commercial products such as computer printers, graphics plotters, and facsimile machines employ ink-jet technology for producing hard copy. The basics of this technology are disclosed, for example, in various articles in the Hewlett-Packard Journal, Vol. 36, No. 5 (May 1985), Vol. 39, No. 4 (Aug. 1988), Vol. 39, No. 5 (Oct. 1988), Vol. 43, No. 4 (Aug. 1992), Vol. 43, No. 6 (Dec. 1992) and Vol. 45, No. 1 (February 1994).

An ink-jet image is formed when a precise pattern of dots is ejected from a drop generating device known as a "printhead" on a printing medium. The typical ink-jet printhead has an array of precisely formed nozzles attached to a thermal ink-jet printhead substrate. The substrate incorporates an array of firing chambers that receive liquid ink (colorants dissolved or dispersed in a solvent) from an ink reservoir. Each chamber has a thin-film resistor, known as a "firing resistor," located opposite the nozzle so ink can collect between the firing resistor and the nozzle. When electric printing pulses heat the thermal ink-jet firing resistor, a small volume of ink adjacent the firing resistor is heated, vaporizing a bubble of ink, and thereby ejecting a drop of ink from the printhead. The droplets strike the printing medium and then dry to form "dots" that, when viewed together, form the printed image. The printhead is held and protected by an outer packaging referred to as a print cartridge. in one aspect of ink-jet ink delivery, the reservoir for storing the ink may be placed in the print cartridge (on-board ink reservoir). The print cartridge has a self-contained reservoir for storing ink and providing appropriate amounts of ink to the printhead during a printing cycle. These are disposable and are replaced when the ink is exhausted. Further, the ink can be stored in the reservoir in different ways. The ink may be stored in a contained medium, such as a permeable foam material (U.S. Pat. No. 4,771,295 (Baker et al)). Alternatively, the ink reservoir can be a free-ink type, having a biased ink bladder or bag as shown in U.S. Pat. No. 5,359,353 (Hunt et al).

One problem in ink-jet printing is that some applications require a large supply of ink. For example, "large format" applications use large size printing media (for example, 22 inch×34 inch, 34 inch×44). Examples of large format applications include computer aided design (engineering drawings), mapping, graphic arts, and posters. The large format printed image can use a large amount of ink either because of the large printed area needing to be covered with ink or the use of 100 percent filled-in image areas, or both. Therefore, it is desirable to have ink reservoirs that contain a large amount of ink to avoid replacing an empty ink reservoir in the middle of a printing cycle or the frequent changing of the ink reservoir between printing jobs.

However, merely increasing the size of the ink reservoir in an on-board system to hold more ink has not proved to be an acceptable solution. The ink reservoir is supported on the printer carriage and moves with the printhead. Increasing the amount of ink in motion would necessarily require an increase in the size and weight of the structure that supports and moves the carriage back and forth. The increased mass of the carriage would also significantly increase the cost of the printer (for example, larger and more expensive electrical motors).

In response, recently, relatively large ink reservoir systems have developed in which the reservoir is mounted off-board. Examples include U.S. Pat. No. 4,831,389 using a low pressure recirculating pumping system; and U.S. Pat. No. 4,968,998 (Allen) which teaches an ink-jet print cartridge which is refillable at a service station.

In contrast to on-board ink reservoirs, printing systems using off-board ink reservoirs require means for delivering the ink from the off-board ink reservoir to the printhead. Pumps can be used for such delivery, but such pumps have problems associated with their use. For example, the ingredients in the ink can be incompatible with the pump components, and such components as diaphragms and seals can degrade when exposed to the ink solvents for extended time periods.

A second problem in ink-jet ink delivery arises in color printing. Color printing typically uses multiple ink reservoirs, each containing ink of a different hue. Since each ink reservoir must be individually pressurized, multiple pumps can be used. However, the addition of each additional pump increases the cost of the overall printing system. Thus, it would be desirable to use one pump that can provide the necessary pressure for all the ink reservoirs individually.

One other problem in ink-jet technology is that the customers have different purchasing criteria. Some customers, with high ink usage rate, may prefer the lower, "unit price" of a large ink reservoir. Other customers, may prefer a lower, "start-up" price of a smaller ink reservoir. Thus, it would be beneficial for the customers to have a printing system that is adaptable to ink reservoirs with different sizes. In addition, the manufacturer also benefits when the size of the ink reservoir is not a limiting factor in the design of the printer or the ink delivery system.

It will be apparent from the foregoing that although there are many processes and apparatus for providing ink to the printhead from an off-board ink reservoir, there is still a need for an approach that provides low material cost and adaptability to various sizes of ink reservoirs, and no requirement for additional pressurization devices.

SUMMARY OF THE INVENTION

Briefly and in general terms, an apparatus for delivering pressurized ink to a printhead, according to the invention, includes a deformable bag for holding ink, a pressurizable container substantially surrounding the bag for exerting fluid pressure on said bag and pressurizing any ink within the bag, and a sealable ink outlet port for fluid conmmunication with the ink bag. The port is fluidically connectable to the printhead so that pressurized ink is deliverable to the printhead.

The invention contemplates a process having the steps of: providing a deformable bag for holding ink for a printhead; substantially surrounding the bag with a pressurizable container; exerting fluid pressure on the bag by pressurizing the container, thereby pressurizing any ink within the bag; and delivering pressurized ink to the printhead.

DESCRIPTION OF THE PREFERRED EMBODIMENTS

Figure 1:
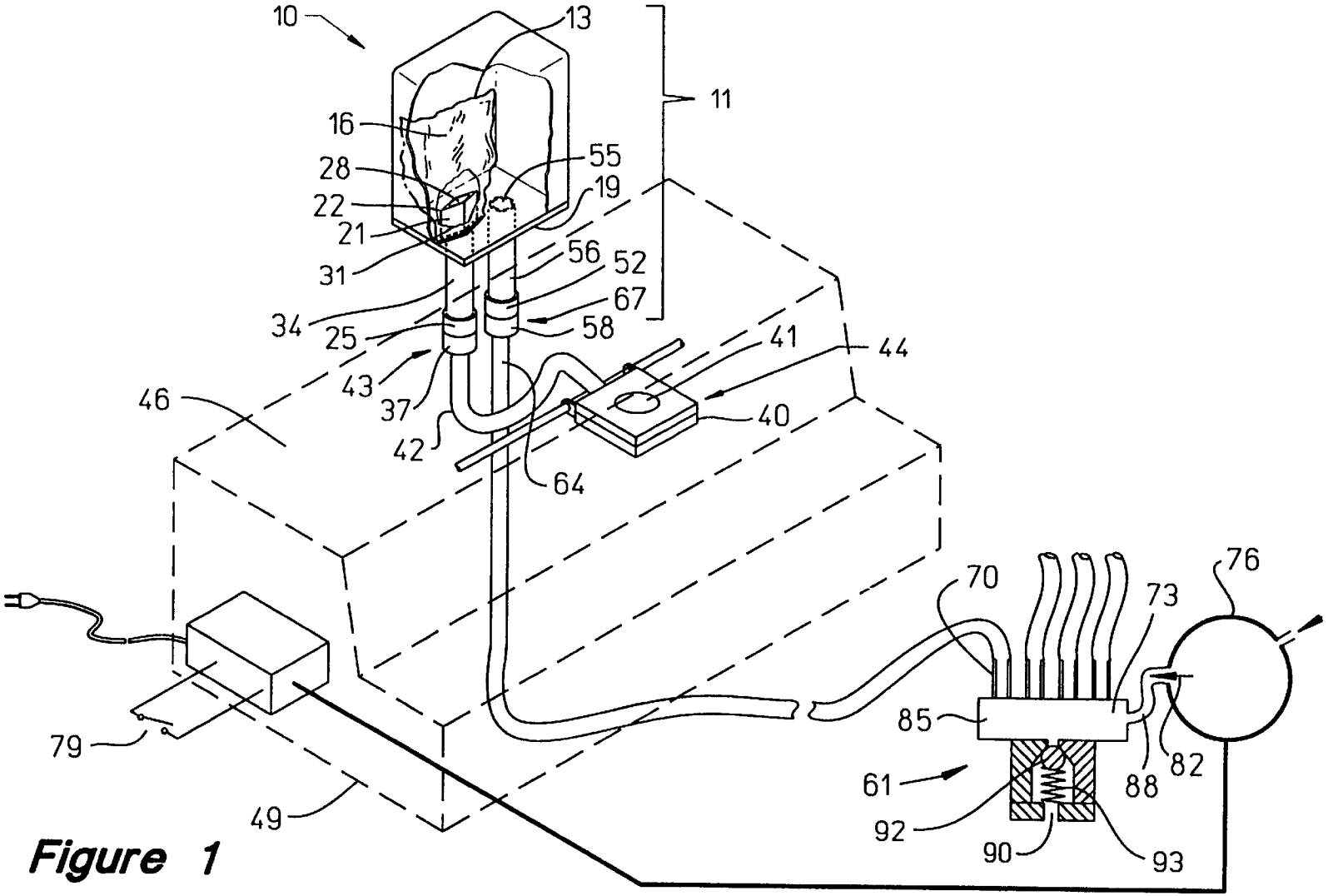
FIG. 1 is a perspective view, partially in section and partially cut away, of an apparatus for delivering pressurized ink to a printhead embodying the principles of the present invention.

Referring to FIG. 1, reference numeral 10 generally indicates a pressurizable container for exerting fluid pressure on a deformable ink bag 13 which contains a liquid ink 16.

The container 10 is an air impermeable rigid container which houses the ink bag 13. The container 10 is attached to a chassis 19 to form a hermetic seal. A method for securing such a seal is to choose the same material, such as HDPE (high density polyethylene), for both the chassis 19 and the container 10 and to use an attachment process such as ultrasonic welding, or heat staking, or adhesive bonding. A gas inlet port 55 allows pressurized air 73 to flow into the container 10.

The ink bag 13 is constructed from a multi-layer metallized polymer film, such as metallized PET (polyethylene terephthalate), with a sealant layer made of LDPE (low density polyethylene). The bag 13 has a high barrier property to water diffusion and other solvents present in the ink 16. The ink bag 13 can be of any shape and size suitable for holding the ink 16. The ink bag 13 is flexible, deformable, and collapses when its contents are emptied.

Figure 2A:
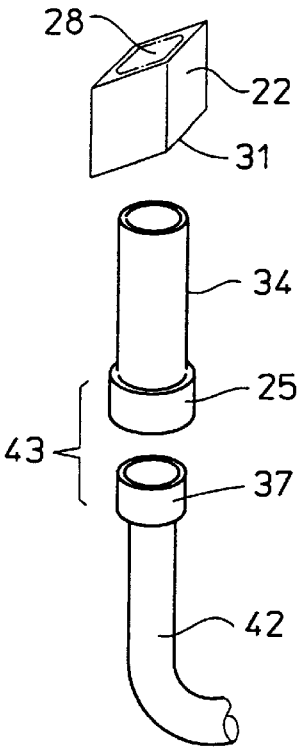
FIG. 2A is an isometric, exploded view of a fluid connection between a pressurizable container and an ink quick disconnect valve.

The ink bag 13 is heat staked onto an external surface 21 of a fin 22 to make a hermetic, fluid tight seal. Also, the fin 22 is attached to the chassis 19 to form a hermetic, fluid tight seal. A method for making the fin to chassis seal is to choose the same material, such as HDPE (high density polyethylene), for both the chassis 19 and the fin 22 and to use an attachment process such as ultrasonic welding, or heat staking, or adhesive bonding. In the preferred embodiment the fin 22 has a diamond shape for manufacturing ease. The fin 22 has two ports, an ink inlet port 28 and an ink outlet port 31. The fin 22 is connected to a first ink conduit 34 at the ink outlet port 31. The first ink conduit has a sealable outlet port 25 and is connected to a second ink conduit 42 by a first male connector 37. The sealable ink outlet port 25 and the first male connector 37 together, make a first quick disconnect valve 43. See FIG. 2A The first male connector 37 is located on a base 46 of a printer 49. The first ink conduit 34 and the second ink conduit 42 are made of a material with high barrier property, such as FEP (fluorinated ethylene propylene), to diffusion of air and ink solvents (including water). The ink 16 is in fluid communication with a print cartridge 44 via the bag 13, the fin 22, the first ink conduit 34 and the second ink conduit 42.

Referring to FIG. 1, reference numeral 44 generally indicates the print cartridge connected to the second ink conduit 42. The print cartridge also includes a printhead 40. The print cartridge is of conventional thermal ink-jet construction and operation. The print cartridge 44 also includes a pressure regulator 41 for converting the pressurized ink 16 from the pressurizable container 10 to a preset back pressure (for example, minus 2 inches of water) required for the printhead 40 to function. When the pressure inside the printhead 40 is lower than atmospheric pressure, a condition exists that is called back pressure (or negative pressure). Back pressure is necessary to keep ink from drooling out of the nozzles (not shown here) of the printhead 40. The pressure regulator 41 is in fluid communication with the ink 16 in the second ink conduit 42 on one side, and the printhead 40 on the other side. Depending on the pressure inside the printhead 40, the pressure regulator 41 allows or stops the flow of the ink 16 to the printhead 40.

Figure 2B:
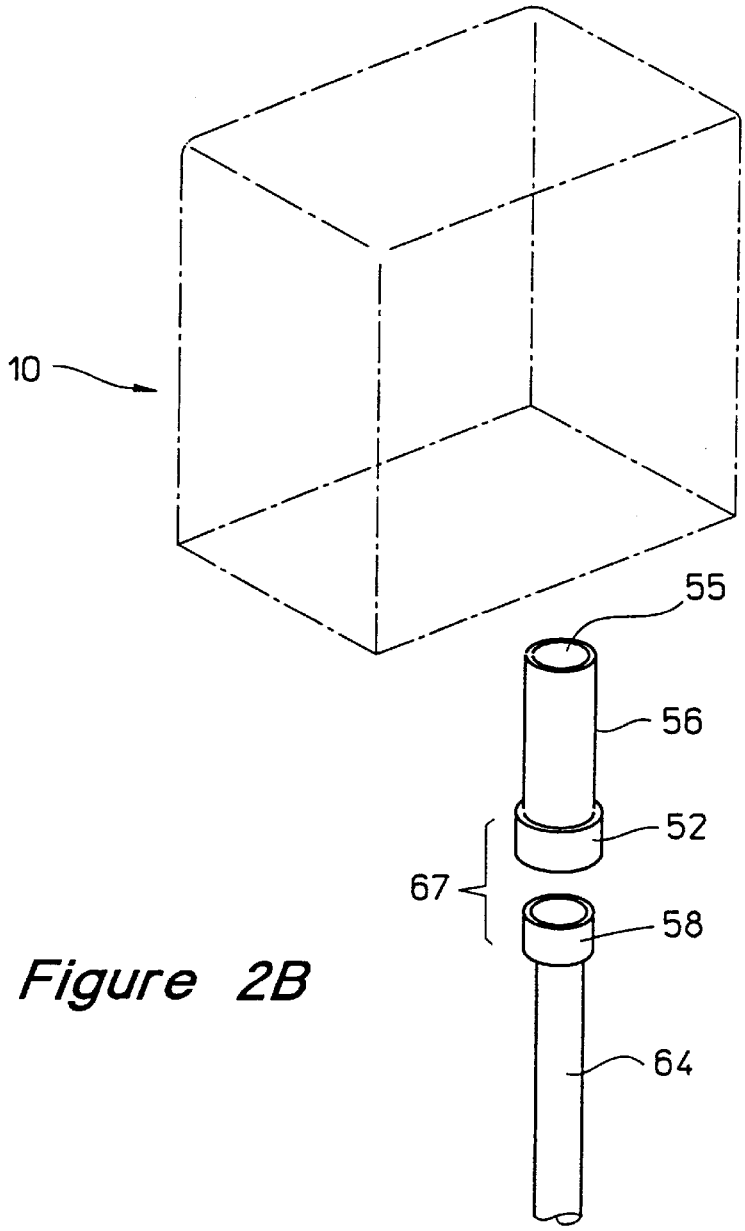
FIG. 2B is an isometric, exploded view of a fluid connection between the pressurizable container and an air quick disconnect valve.

Further referring to FIG. 1, the container 10 is in fluid communication with a first gas conduit 56 having a sealable gas inlet port 52 and the gas inlet port 55. The gas inlet port 55 is received in the container 10. The first gas conduit 56 is connected to a second gas conduit 64. The second gas conduit has a second male connector 58 that is insertable into the sealable gas inlet port 52. The sealable gas inlet port 52 and the second male connector 58 together, make a second quick disconnect valve 67. See FIG. 2B. The second male connector 58 is located on the base 46 of the printer 49. The first gas conduit 56 and the second gas conduit 64 are made of any material that can support an air pressure of about two pounds per square inch (psi).

The container 10, the ink bag 13, the fin 22, the chassis 19, the first ink conduit 34, the first gas conduit 56, the sealable ink outlet port 25, and the sealable gas inlet port 52 are collectively referred to as an ink containment device 11.

Referring to FIG. 1, reference numeral 61 generally indicates an air manifold. The air manifold 61 contains a first gas outlet port 70 for providing air 73 to the container 10 via the second gas conduit 64. The number of the first gas outlet ports 70 on the manifold is a matter of design to accommodate all the pressurizable containers 10 that house the ink bags 13. Only one container and ink bag is illustrated in FIG. 1 to avoid redundancy. In a typical color ink-jet printing device there are four ink reservoirs: black, magenta, cyan, and yellow. Thus, on such a color printer the air manifold 61 has four first gas outlet ports 70. An air compressor 76 is electrically connected to the printer 49 so that the compressor 76 is turned on when the printer 49 signals the air compressor. The air compressor 76 has a second gas outlet port 82 which is connected to an air chamber 85 in the air manifold 61 via a third gas conduit 88. The air compressor 76 can be any commercially available unit capable of providing air at a pressure of about 2 psi and at an air flow rate of about 150 cc/min.

The air manifold 61 has an air bleed vent 90 for providing a continuous bleed. The bleed vent is a commercially available ball 92 and spring 93. The purpose of the continuous bleed is to minimize the exposure of the seals in the system to an elevated pressure when the printer is not in operation and second, to equilibrate the system's pressure and to avoid over pressurization during operation. When the pressure inside the air chamber 85 exceeds the desired pressure of 2 psi, the ball 92 compresses the spring 93 to allow excess air to exit through the air bleed vent 90.

Referring to FIG. 1, in operation, the first male connector 37 and the second male connector 58 are inserted into the sealable ink outlet port 25 and the sealable gas inlet port 52, respectively. These insertions bring the ink containment device 11 in fluid communication with the printhead 40 and the air manifold 61. The power switch 79 of the printer 49 is switched to the "on " position, energizing the air compressor 76.

When the air compressor 76 is turned on, the air 73 flows in turn through the second gas outlet port 82, the third gas conduit 88 and into the air chamber 85. The air 73 is then directed to the first gas outlet port 70 and thereafter through the second gas conduit 64, the second quick disconnect valve 67, the first gas conduit 56, the gas inlet port 55 and into the container 10.

The pressure of the air inside the container 10 exerts a pressure on the ink bag 13 containing the ink 16. This pressure causes the ink 16 to flow through the ink inlet port 28 and thereafter through the fin 22, the ink outlet port 31, the first ink conduit 34, the first quick disconnect valve 43, the second ink conduit 42 and into the pressure regulator 41.

As the ink is jetted out of the printhead 40, the pressure inside the print head 40 decreases until it reaches a preset back pressure. The difference between the back pressure on one side of the pressure regulator 41, in communication with the printhead 40, and the more positive ink pressure on the other side of the pressure regulator 41, in communication with the ink in the second ink conduit 42, causes the pressure regulator 41 to open and to allow the ink 16 to flow into the printhead 40. When the pressure in the printhead 40 reaches the preset operating pressure, the flow of ink stops and the differential pressure across the pressure regulator is equilibrated.

Figure 3:
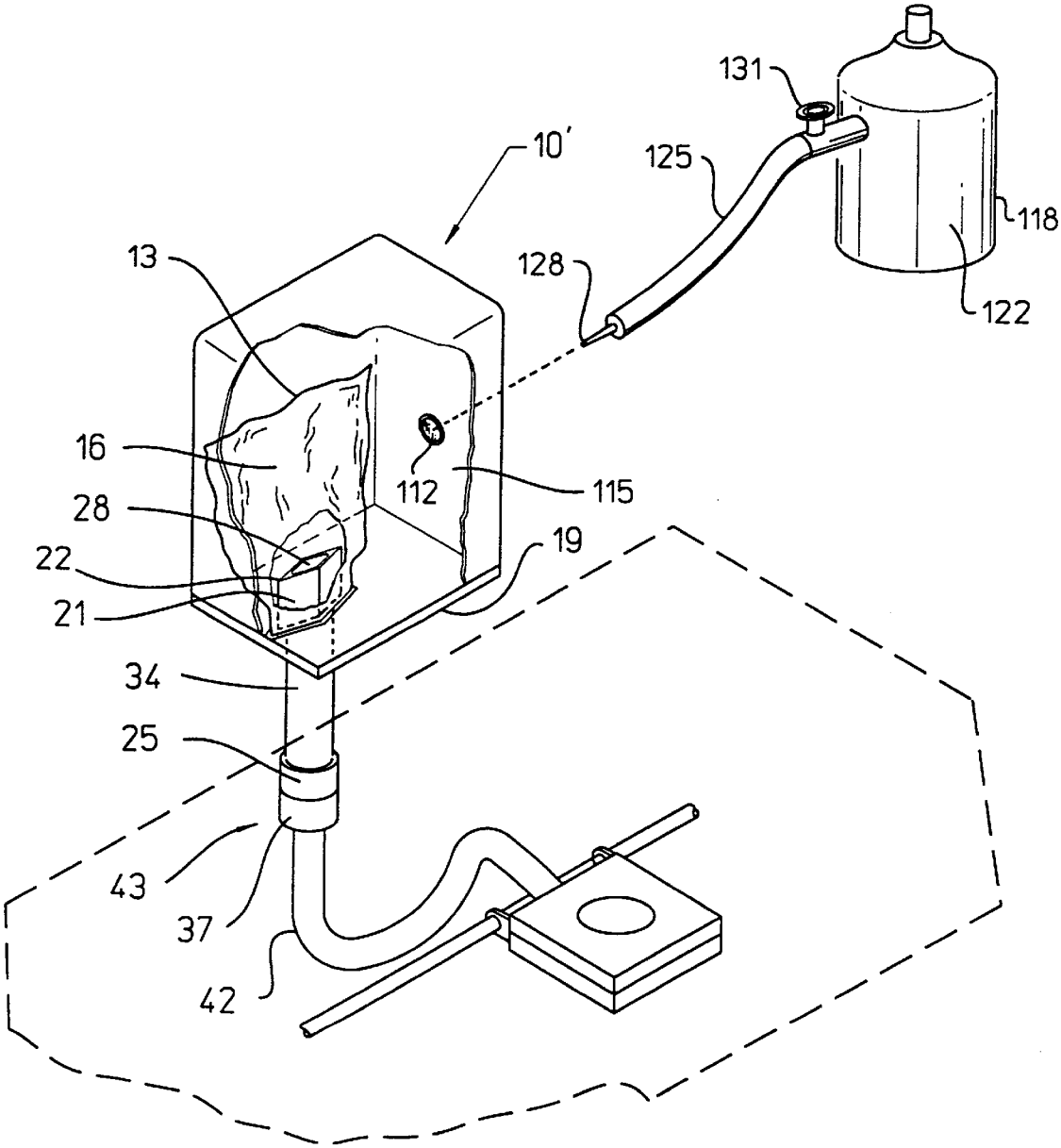
FIG. 3 is a perspective view, partially in section and partially cut away, of a second embodiment of the present invention showing a pressurized fluid in fluid communication with the pressurizable container.

FIG. 3 illustrates an alternative embodiment of the present invention. For the two embodiments like reference numerals indicate like components. In referring to FIG. 2, reference numeral 10' generally indicates a pressurizable container for exerting pressure on the deformable ink bag 13 which contains the liquid ink 16. A sealable fluid inlet 112, such as a septum, is located in a sidewall 115 of the container 10' for receiving a pressurized fluid 122 such as air. A pressurized fluid cylinder 118 holds the pressurized fluid 122. The pressurized fluid 122 is in fluid communication with the container 10' through a pressure regulator 131, a fluid conduit 125, and a hollow needle 128. The needle is insertable into the septum 112. The pressure regulator 131 is commercially available and is set for a pressure of about 2 psi. The fluid conduit 125 is made of any material that can support an air pressure of about 2 psi.

Referring to FIG. 3, in operation, the hollow needle 128 is inserted into the septum 112. The pressurized fluid cylinder 118 is opened and the pressurized fluid 122 moves through the pressure regulator 131, the fluid conduit 125, the needle 128, and into the container 10'. The needle 128 can remain in the septum during normal operation. Upon inserting the first male connector 37 into the sealable ink outlet port 25, the system is ready for operation in the same manner as described above in connection with FIG. 1.

It should be appreciated that: any pressurizable fluid, including a liquid, that is compatible with the pressurization system can be used in place of the air 73 and the fluid 122; the fin 22 has a diamond shape but any other shape that can accommodate the ink bag 13 and the chassis 19 can be used; the preset back pressure is minus 2 inches of water but the pressurization system described here can accommodate any other back pressure requirements that the printhead 40 may have; only one type of air compressor 76 is described but any type of pump capable of providing the desired air pressure and flow rate may be used such as those pumps used in fish aquariums; and the desired pressure in the ink conduits, the gas conduits, and the containers 10 and 10' is 2 psi but pressures in the range from minus 10" of water to over 45 psi can be used.

Although, specific embodiments of the invention have been described and illustrated, the invention is not to be limited to the specific forms or arrangement of parts so described and illustrated. The invention is limited only by the claims.

I claim:

1. A pressurized ink delivery system for an ink jet printer comprising:

a print cartridge having a printhead; and a pressure regulator, said pressure regulator being connected between an ink input into said print cartridge and an ink outlet in fluid communication with said printhead, said pressure regulator detecting a negative ink pressure, relative to atmospheric pressure, in said print cartridge more negative than a preset limit and allowing ink to flow from said ink input to said ink output until said ink pressure is within a preset negative pressure range; and an ink supply for said print cartridge, said ink supply including:

a deformable ink bag containing said ink;

a rigid container substantially surrounding said ink bag;

an ink supply tube connected between said ink bag and said ink input of said print cartridge; and a pressurizing device generating a positive pressure, relative to the atmospheric pressure, said pressurizing device having an outlet connected to said rigid container, said pressurizing device providing said positive pressure internal to said rigid container, causing said ink within said ink bag to be delivered through said ink supply tube to said ink input of said print cartridge at said positive pressure at all times while said printhead is operating.

2. The system of claim 1 wherein said pressurizing device continuously operates to provide ink at said positive pressure through said ink supply tube while said printhead is operating.

3. The system of claim 2 wherein said pressurizing device continuously operates to provide a positive pressure internal to said rigid container while said printhead is operating, said system further comprising:

a bleed valve connected to said rigid container for allowing air to escape from said rigid container to the atmosphere upon said positive pressure within said rigid container exceeding a preset level.

4. The system of claim 1 wherein said pressurizing device is a pump, said pump being electrically activated while said printhead is operating.

5. The system of claim 1 wherein said printhead forms a portion of an inkjet printer, wherein ink droplets are expelled from said printhead when said printhead is operating.

6. A method for delivering pressurized ink to a printhead comprising:

providing a print cartridge having a printhead; and a pressure regulator, said pressure regulator being connected between an ink input into said print cartridge and an ink outlet in fluid communication with said printhead, said pressure regulator detecting a negative ink pressure, relative to atmospheric pressure, in said print cartridge more negative than a preset limit and allowing ink to flow from said ink input to said ink output until said ink pressure is within a preset negative pressure range;

operating said printhead to print on a medium;

generating a negative pressure internal to said print cartridge as said printhead is printing;

providing an ink supply for said print cartridge, said ink supply including: a deformable ink bag containing said ink; a rigid container substantially surrounding said ink bag; an ink supply tube connected between said ink bag and said ink input of said print cartridge; and a pressurizing device generating a positive pressure, relative to said atmospheric pressure, said pressurizing device having an outlet connected to said rigid container, said pressurizing device providing said positive pressure internal to said rigid container, causing said ink within said ink bag to be delivered through said ink supply tube to said ink input of said print cartridge at said positive pressure at all times while said printhead is operating; and providing said ink at a positive pressure through said ink supply tube and to said ink input as said printhead is printing on said medium.

7. The method of claim 6 wherein said step of providing said ink at said positive pressure comprises continuously operating said pressurizing device to provide said ink at said positive pressure through said ink supply tube while said printhead is operating.

8. The method of claim 7 wherein said step of providing said ink at said positive pressure comprises:

continuously operating said pressurizing device to provide said positive pressure internal to said rigid container while said printhead is operating; and automatically actuating a bleed valve connected to said rigid container for allowing air to escape from said rigid container to the atmosphere upon said pressure within said rigid container exceeding a preset level.

9. The method of claim 6 wherein said pressurizing device is a pump, and said step of providing said ink at said positive pressure comprises continuously operating said pump while said printhead is operating.

10. The method of claim 6 wherein said printhead forms a portion of an inkjet printer, and wherein operating said printhead comprises expelling ink droplets from said printhead when said printhead is operating.

11. An pressurized ink supply for an ink jet printer, said ink jet printer including a print cartridge comprising a printhead and a pressure regulator, said pressure regulator being connected between an ink input into said print cartridge and an ink outlet in fluid communication with said printhead, said pressure regulator detecting a negative ink pressure, relative to atmospheric pressure, in said print cartridge more negative than a preset limit and allowing ink to flow from said ink input to said ink output until said ink pressure is within a preset negative pressure range, said ink supply comprising:

a deformable ink bag containing said ink;

a rigid container substantially surrounding said ink bag;

an ink supply tube connected between said ink bag and said ink input of said print cartridge; and a pressurizing device generating a positive pressure, relative to said atmospheric pressure, said pressurizing device having an outlet connected to said rigid container, said pressurizing device providing said positive pressure internal to said rigid container, causing said ink within said ink bag to be delivered through said ink supply tube to said ink input of said print cartridge at said positive pressure at all times while said printhead is operating.

* * * * *